US005813267A

United States Patent [19]

Aschberger et al.

[11] Patent Number: 5,813,267

[45] Date of Patent: Sep. 29, 1998

[54] METHODS AND APPARATUS FOR REDUCING FLANGE WIDTH VARIATIONS IN DIE NECKED CONTAINER BODIES

[75] Inventors: Anton A. Aschberger, Downers Grove; James M. Abrahamson, Waukegan; Isaac R. Dandan, Lombard, all of Ill.

[73] Assignee: Crown Cork & Seal Company, Inc., Philadelphia, Pa.

[21] Appl. No.: 608,125

[22] Filed: Feb. 28, 1996

[51] Int. Cl.[6] ..... B21D 51/26

[52] U.S. Cl. ..... 72/125; 72/356; 413/69

[58] Field of Search ..... 72/94, 105, 106, 72/110, 111, 125, 356; 413/69

[56] References Cited

U.S. PATENT DOCUMENTS

| | | | |
|---|---|---|---|
| 3,797,431 | 3/1974 | Yoshimura | 113/120 AA |
| 3,812,696 | 5/1974 | Kneusel et al. | 413/69 |
| 3,964,413 | 6/1976 | Saunders | 113/120 AA |
| 3,983,729 | 10/1976 | Traczyk et al. | 72/43 |
| 3,995,572 | 12/1976 | Saunders | 113/120 H |
| 4,003,324 | 1/1977 | Tate et al. | 413/69 |
| 4,018,176 | 4/1977 | Gnyp et al. | 113/1 G |
| 4,272,977 | 6/1981 | Gombas | 72/121 |
| 4,341,103 | 7/1982 | Escallon et al. | 72/70 |
| 4,392,764 | 7/1983 | Kubis et al. | 413/69 |
| 4,403,493 | 9/1983 | Atkinson | 72/356 |
| 4,435,969 | 3/1984 | Nichols et al. | 72/126 |
| 4,450,700 | 5/1984 | Robertson, Jr. et al. | 72/115 |
| 4,512,172 | 4/1985 | Abbott et al. | 72/68 |
| 4,519,232 | 5/1985 | Traczyk et al. | 72/133 |
| 4,557,167 | 12/1985 | Cvacho | 82/47 |
| 4,563,887 | 1/1986 | Bressan et al. | 72/84 |
| 4,693,108 | 9/1987 | Traczyk et al. | 72/370 |
| 4,732,027 | 3/1988 | Traczyk et al. | 72/133 |
| 4,747,287 | 5/1988 | Azzaline et al. | 72/125 |
| 4,760,725 | 8/1988 | Halasz | 72/84 |
| 4,774,839 | 10/1988 | Caleffi et al. | 72/354 |
| 4,781,047 | 11/1988 | Bressan et al. | 72/84 |
| 4,815,348 | 3/1989 | Ashbolt et al. | 83/383 |
| 4,854,149 | 8/1989 | Porucznik et al. | 72/352 |
| 5,138,858 | 8/1992 | Johnson et al. | 72/68 |
| 5,235,839 | 8/1993 | Lee, Jr. et al. | 72/117 |
| 5,245,848 | 9/1993 | Lee, Jr. et al. | 72/84 |
| 5,249,449 | 10/1993 | Lee et al. | 72/352 |
| 5,282,375 | 2/1994 | Lee, Jr. et al. | 72/4 |
| 5,297,414 | 3/1994 | Sainz | 72/354.6 |
| 5,349,836 | 9/1994 | Lee, Jr. | 72/84 |
| 5,349,837 | 9/1994 | Halasz et al. | 72/94 |
| 5,355,710 | 10/1994 | Diekhoff | 72/379.4 |
| 5,465,599 | 11/1995 | Lee, Jr. | 72/94 |

FOREIGN PATENT DOCUMENTS

| | | | |
|---|---|---|---|
| 0 507 380 A1 | 10/1992 | European Pat. Off. . | |
| 0 570 005 A2 | 11/1993 | European Pat. Off. . | |
| 0 582 984 A1 | 2/1994 | European Pat. Off. . | |
| 623405 | 9/1994 | European Pat. Off. . | |
| 58-35028 | 3/1983 | Japan | 413/69 |
| 1212773 | 11/1970 | United Kingdom . | |
| 83/02577 | 8/1983 | WIPO | 413/69 |

*Primary Examiner*—Lowell A. Larson
*Attorney, Agent, or Firm*—Woodcock Washburn Kurtz Mackiewicz & Norris LLP

[57] ABSTRACT

Methods and apparatus for improving the concentricity and reducing the flange width variation of a die-necked container body are disclosed. A piloted pad is inserted into the dome at the bottom of the can, either as part of the flanging operation or as part of a die necking operation, or both. The insertion of the pilot and pad orients the can body relative to the necker or flanger so that the open end of the can remains concentric with the main body diameter as forming operations progress. Preferably, when used as part of a die necker, the pusher pad connected to the pilot is spring loaded. By spring-loading the pusher pad, accidental engagement between the raised section that extends into the dome is prohibited, and each can is more readily ejected and transferred.

20 Claims, 6 Drawing Sheets

METHODS AND APPARATUS FOR REDUCING FLANGE WIDTH VARIATIONS IN DIE NECKED CONTAINER BODIES

The present invention relates to methods and apparatus for manufacturing containers, particularly for manufacturing aluminum drawn and ironed beverage containers. More specifically, the present invention relates to apparatus used in the flanging of the container body and in the process of reducing the diameter of the open end of a body using a technique known as die necking.

BACKGROUND OF THE INVENTION

For many years, the beverage container industry has sought to reduce the weight and amount of metal used in drawn and ironed beverage cans (i.e., two piece cans) by reducing the diameter of the open end of the body so that a smaller diameter closure can be utilized. The closure represents a significant amount of the metal in this type of container, thus it is desirable to reduce the diameter of the closure and thereby reduce the amount of metal in the container.

There are two basic techniques used to transform the roughly cylindrical drawn and ironed can body into a semi-finished container with a tapered neck. These are generally characterized as either "spin necking" or "die necking." As their names imply, spin necking involves rotating the cylindrical container about its center line axis and applying pressure to the open end so that the diameter of the open end is reduced, while die necking involves moving the open end of the can over a series of progressive dies that gradually reduce the diameter of the open end of the can while providing a tapered smooth surface.

Examples of patents describing spin necking are U.S. Pat. No. 5,349,836—Lee, Jr. and U.S. Pat. No. 4,781,047—Bressan et al. Although spin necking can produce usable can bodies, it has been found that for a variety of reasons it is desirable to employ die necking in order to mass produce can bodies. U.S. Pat. No. 3,983,729—Traczyk et al. discloses a die necking apparatus that also creates the flange on the end of the container that is used to attach the closure to the body. U.S. Pat. No. 4,774,839—Caleffi et al. generally describes a die necking operation wherein a series of turrets are used to transfer the container to each of the stages in the operation. The equipment associated with each turret has a die having a slightly different diameter and degree of taper, so that the end diameter and the shape of the neck of the can body is gradually reduced as the article is progressively advanced through the apparatus. The considerations that go into the determination of the die shapes for each stage is well known, such as that illustrated by U.S. Pat. No. 5,355,710—Diekhoff. All these patents are incorporated herein by reference.

Thus, the basic operation of die necking is well known. However, as there is always an effort to further reduce the end diameter of a container body, coupled with the need to be able to produce such can bodies using high speed production equipment, certain shortcomings of the die necking process become apparent. In particular, it has been found that when container bodies are necked to a small enough diameter, conventional techniques produce a body which is not perfectly concentric with the starting can diameter, and which exhibits a great deal of dimensional variation in the area of the flange. This lack of concentricity is critical since a non-concentric opening will result in eccentric loads being created when the can is eventually filled, closed and pressurized. The moments produced by the eccentric loads will result in buckling or other failures of the container which are completely unacceptable.

As known in the art and illustrated by the above-referenced patents, flanging requires the use of small rollers to incrementally form the flange without producing split flanges. As these rollers form the flange, the can must be prevented from rotating. On the most commonly used commercial flanging machines, the can rests on a rubber pad which provides friction, however, the friction also prevents the can from aligning itself centrally with the center of the flanging roller assembly. When the can is not centered, an uneven flange is produced.

Thus, it would be desirable to provide methods and apparatus wherein the concentricity of the necked portion of a container body can be controlled to within a very tight tolerance relative to the starting diameter of the can. Moreover, it would be further desirable to insure that the flange created from such a container body would similarly remain within tight dimensional tolerances. It is therefore an object of the present invention to provide an apparatus for use in conjunction with a die necking apparatus that will provide a container having a reduced diameter open end, but which will remain within the required tolerances and produce a more reliable and stable neck that is able to withstand the pressures required of a container filled with carbonated beverages.

SUMMARY OF THE INVENTION

Accordingly, it has been found that objects set forth above can be achieved by a push pad and center pilot disposed within the domed bottom of the can prior to the beginning of the necking operation, and which remains against the can body during the necking operation, and thus will maintain the final diameter of the container body within specifications as to the concentricity of the container body and as to its overall dimensions. To center the can, a pusher pad that has a pilot that conforms to the periphery of the domed bottom is provided by the present invention. One preferred embodiment is 0.110 inches deep, but poses stripping problems. A more preferred embodiment has a pilot that is 0.030 deep and three spring loaded buttons to lift the can off the pilot for smooth transfer after flanging.

The cause of the problem discussed above—flange variation—is essentially caused by three controllable variables: neck concentricity, can position, and pusher wear. The present invention, when applied to flanging, reduces or eliminates problems caused by can positioning. The same methods and apparatus can also be applied to necking, and solve the concentricity problem described above. The choice of material can eliminate the wear problem.

The pusher pad of the present invention is also useful during necking operations, and operates the same way to provide the same benefits.

DETAILED DESCRIPTION OF THE PREFERRED EMBODIMENTS

Figure 1:
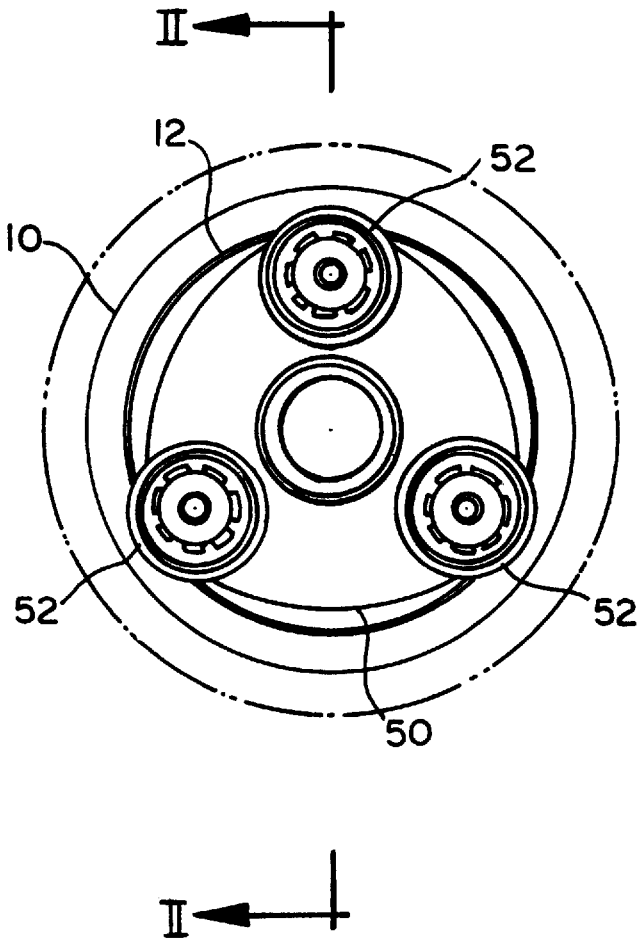
FIG. 1 is an end view of apparatus used to create a flange on a can body.

Referring now to FIG. 1 an end view of a flanging apparatus 50 is shown. The apparatus has three flanging rollers 52 that engage the open end 12 of a can body 10. Further details of the flanging apparatus 50 can be seen in the cross-section shown in FIG. 2. Although the equipment illustrated is currently used to produce flanges on cans, as explained above, flange width variation does occur and presents an on-going but as yet unsolved problem. There are a number of causes for flange width variation. These include cases where the neck is not concentric to the can body, those where the can is positioned off center, cases where the support pad is grooved, and those where there is uneven elongation due to the roller shape. Flange width variation may also be caused by the flange being distorted by the bottom reformer and by can height variation or by variations in the "thick wall" of the unreformed blank can.

Figure 3:
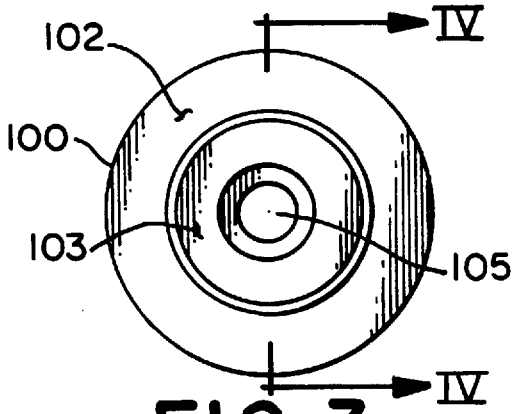
FIG. 3 is an end view of a piloted flanger pusher pad made in accordance with the present invention.
Figure 4:
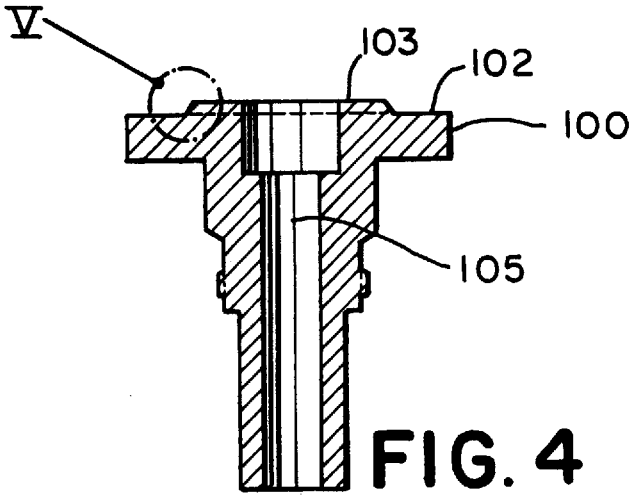
FIG. 4 is a cross-sectional side view, taken along line IV—IV of FIG. 3, illustrating the profile of the pusher pad.
Figure 5:
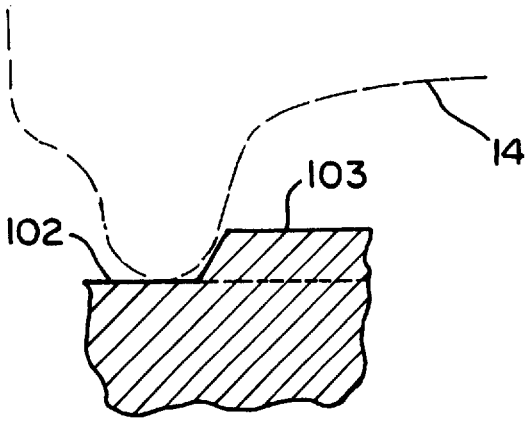
FIG. 5 is an enlarged, broken away view of the portion of FIG. 4 designated V.

Nonetheless, whatever the cause of the flange width variation, it has now been found that a significant reduction in this variation can be achieved using the methods and apparatus of the present invention. Referring simultaneously to FIGS. 3–5, a flanger push pad 100 made in accordance with the present invention is illustrated. As shown, the flanger pusher pad 100 is circular and has a recessed surface 102 and raised surface 103. FIG. 5 illustrates a preferred relationship between these two surfaces, and the connection between them. The shape of the pusher pad is chosen so that it fits closely into the dome of the can bottom 14, seen in FIG. 5. Those of skill in the art will readily adapt the concept disclosed herein to the variety of bottom profiles that are created. Although the distance between the surfaces 102,103 can be as much as 0.110 inches, this dimension poses stripping problems and a distance of 0.030 inches represents a more preferred embodiment of the present invention.

Figure 2:
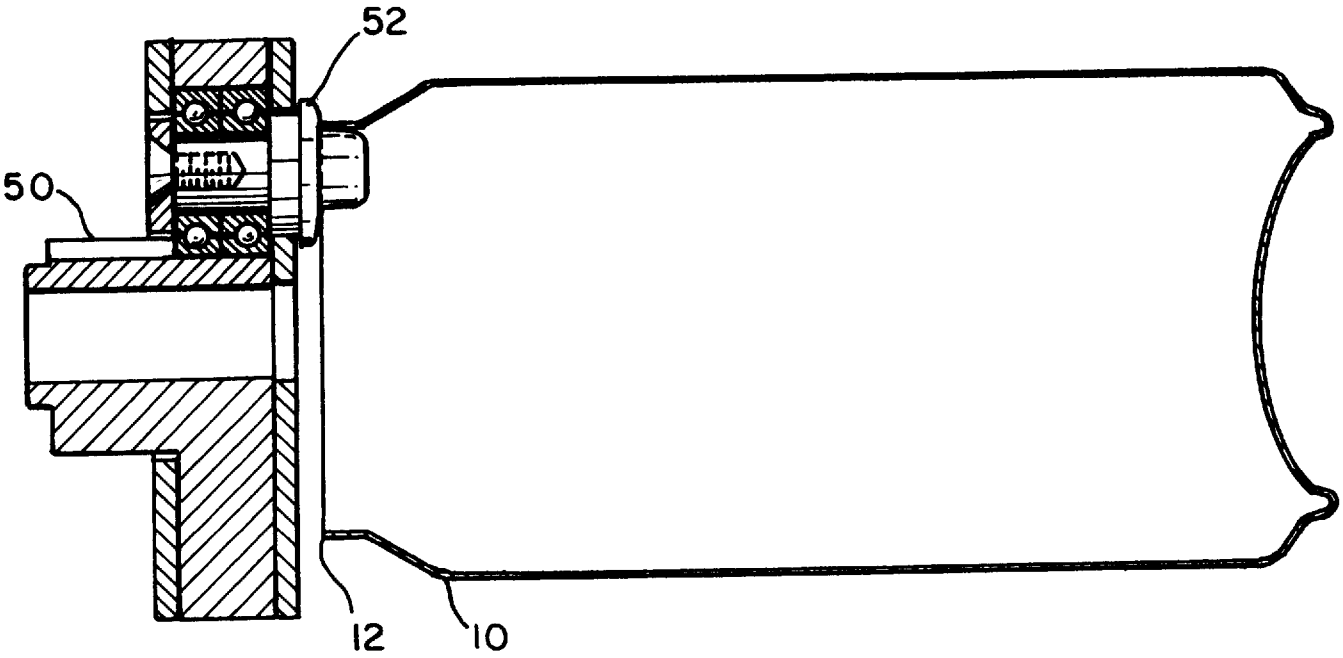
FIG. 2 is a crops-sectional side view, taken long line 11—11 of FIG. 1, illustrating the engagement of the flanging apparatus and the can.

As mentioned above, the flanger pusher pad 100 of the present invention can be used cooperatively with the apparatus illustrated in FIGS. 1–2 to reduce flange width variation. As seen in FIG. 5, the surface 103 enters the domed end of the can prior to the flange rollers 52 engaging the open end of the can. The pilot hole 105 receives a clamping screw. This screw locks pusher 100 into the machine ram (not shown) and the screw is preferably hollow to allow a vacuum to pass through and pull the dome bottom 14 against surface 102. Thus, tight tolerances can be held and a vastly improved product obtained. Importantly, the insertion and withdrawal of the pusher pad 100 does not add significantly to the stroke of the press operations, while conferring the benefits noted above.

Figure 6:
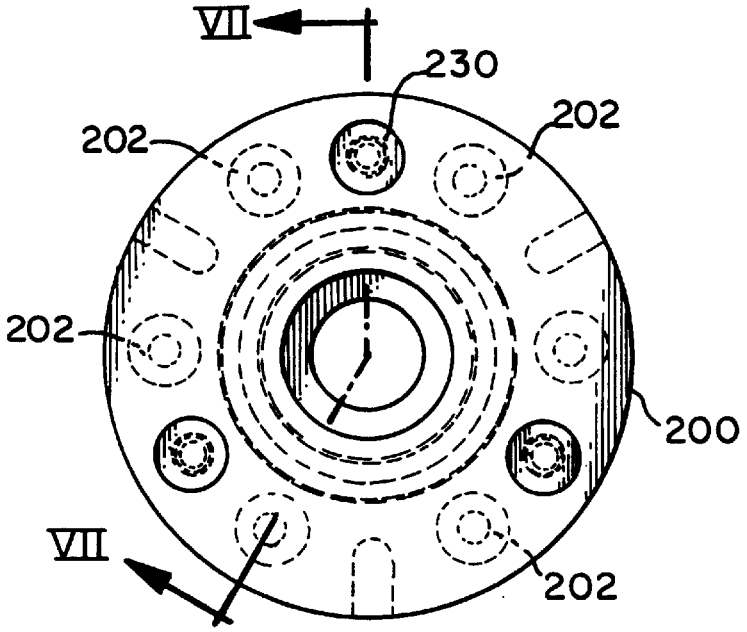
FIG. 6 is an end view of a spring-loaded piloted usher pad made in accordance with the present invention.
Figure 7:
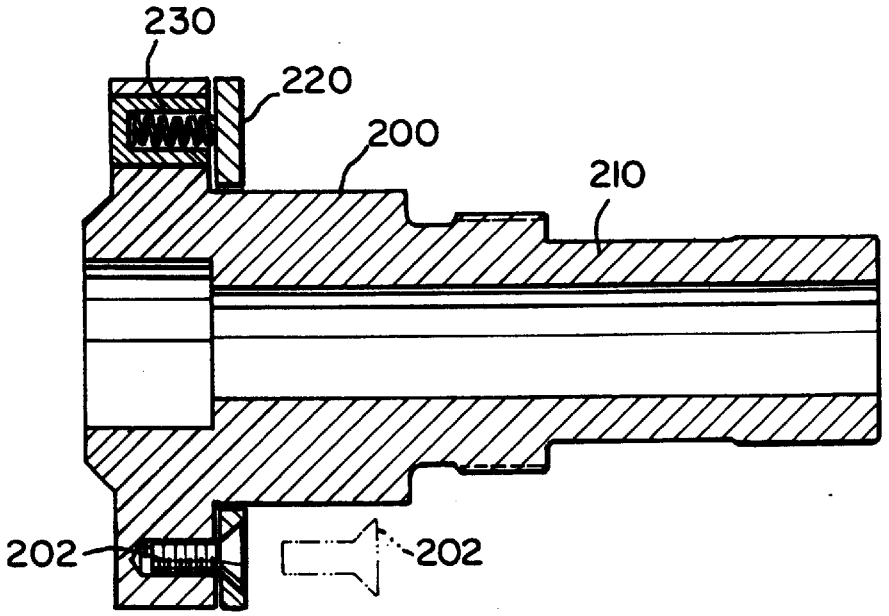
FIG. 7 is a cross-sectional side view, taken along line VII—VII of FIG. 6, illustrating the details of the assembly.
Figure 10:
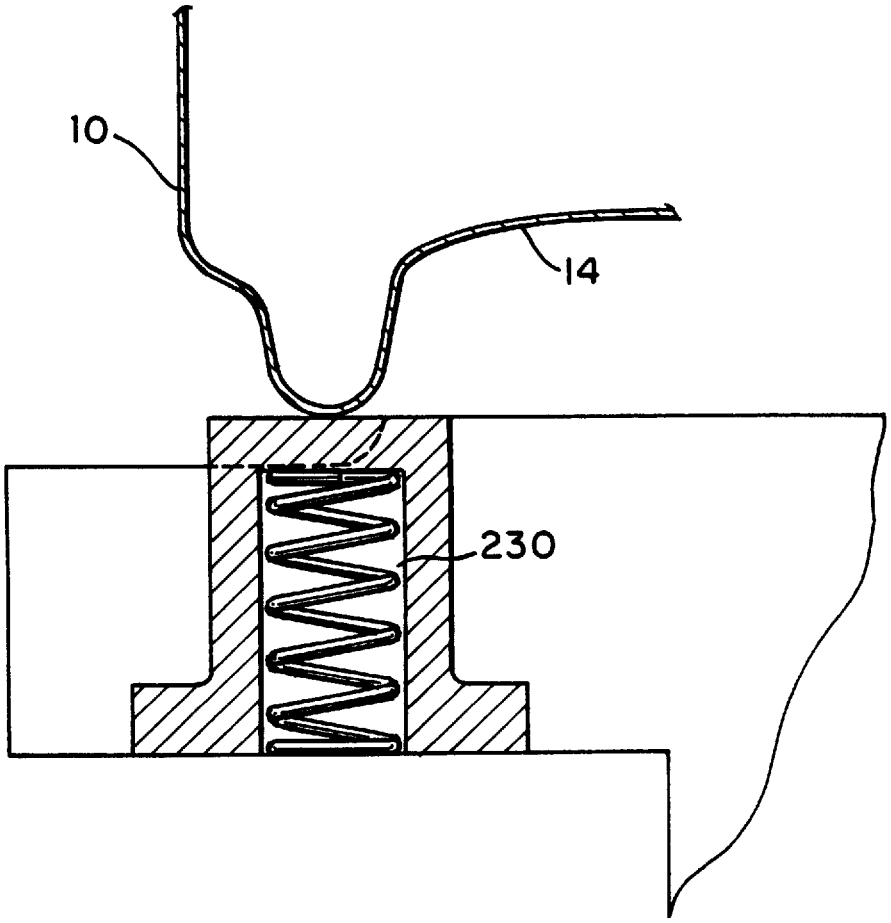
FIG. 10 is a broken away and enlarged side view of the spring-loaded pusher pad illustrated in FIGS. 6–7 in operation.

The present invention is also useful in die necking apparatus. A most preferred embodiment of the present invention is illustrated in FIGS. 6–7 and 10 being used in such an application. As shown, the necker pusher pad assembly 200 is in many ways similar to that shown in FIGS. 3–5. However, the improvement in this embodiment is that the stripping problems mentioned above have now been eliminated. It should be understood, however, that either embodiment may be used with either flanging or necking apparatus. Nonetheless, the embodiment illustrated in FIGS. 6–7 and 10 represents the most preferred embodiment of the present invention and is presently the best mode known for carrying out the invention.

The necker push pad assembly 200 is comprised of a pilot section 210, seen in FIG. 7, and a spring retaining plate 220. The pilot section 210 and the spring retaining plate 220 are joined by fasteners 202. The relationship between the pilot section 210 and the spring retaining plate 220 is maintained by a series of spring-loaded pins 230 disposed around its circumference.

The spring-loaded buttons provide smooth can transfer during loading and unloading. In typical operations, the can is inserted and removed from the necking or flanging machinery in a horizontal motion, thus the protrusion of the pilot of the present invention will possibly impede this process. Although the possibility of the can becoming accidentally retained in the machinery can be reduced by the degree of chamfer between the raised and recessed surfaces of the pilot and the dimensional distance between these surfaces, further improvements can be made. The spring-loaded pusher pad seen in FIGS. 6–7 and 10 all but eliminates these problems by positively ejecting the can from the pilot. As seen in FIG. 10, the buttons are retracted by the process loads while the can is necked or flanged. However, when the process load is removed, the load provided by the spring that urges the button upwardly creates a force that also lifts the can from the pusher. Therefore, as the can slides across the pusher pad without being damaged by or becoming engaged with the transition between the two surfaces on the pusher pad.

Figure 8:
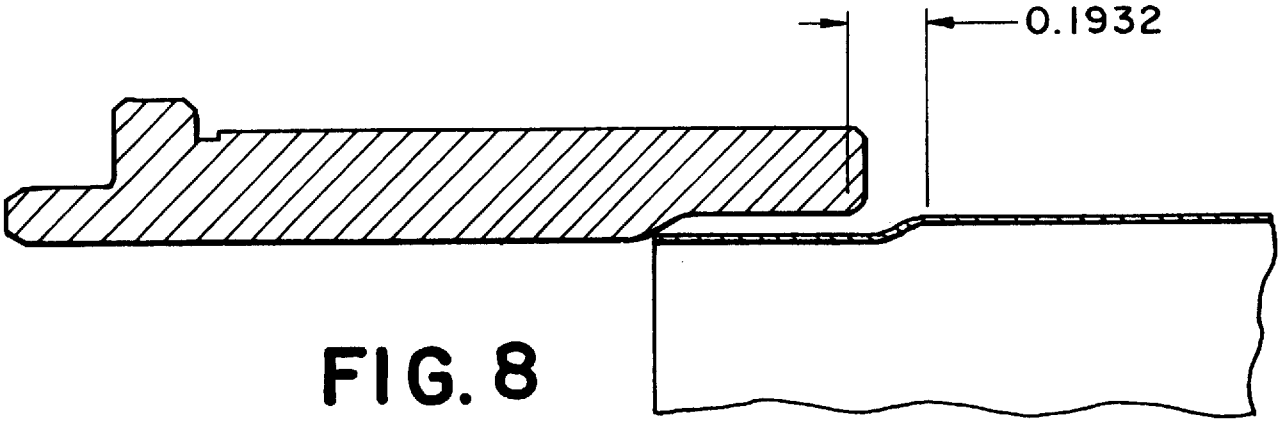
FIG. 8 is a cross-sectioned, broken away enlarged side view of part of the second stage necking die engaging a can that has a first stage neck.
Figure 9:
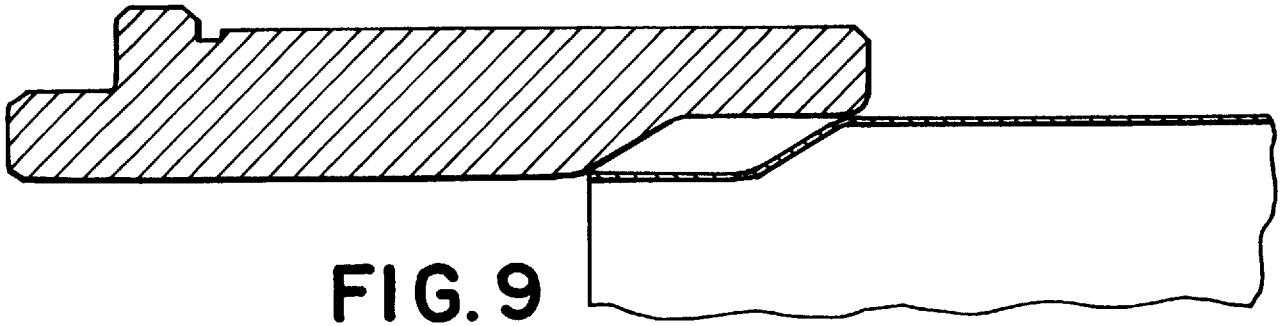
FIG. 9 is a crass-sectioned broken away enlarged side view of part of the seventh stage necking die engaging a can that has a sixth stage neck.

An illustration of the necker push pad assembly 200 shown in FIGS. 7–8 in operation is shown in FIGS. 8–9. FIG. 8 illustrates one of the initial necking stages, in which a second stage necking die is engaging a can with a first stage neck. FIG. 9 illustrates one of the latter stages of the necking, showing a seventh stage die and a can with a sixth stage neck. The necking operation shown in FIGS. 8–9 is part of an eleven stage necking process where the ultimate neck produced is designated "204," i.e., the diameter is 2 inches and "04" sixteenths or 2.24. In a "204" size the neck diameter is actually 2.161 inches. This sizing system is well known in the art.

The 0.1932 inch dimension illustrates a die configuration that permits the can to enter into the second operation die by 0.193 inches before the die reaches the outside can diameter and begins to perform a centering operation. FIG. 9 illustrates that only after the seventh operation is the neck shallow enough to permit any centering. It will be understood by those of skill in the art that the die profile chosen will alter the dimensions and thus the relative positions of both the dies and related equipment and the can.

As was the case with the embodiment of the present invention directed to the flanging operation, the necking pusher pad 200 improves the accuracy and repeatability of the process of centering the can body on the necking dies.

Although certain embodiments of the present invention have been set forth above with specificity, it is to be understood that these embodiments are provided for purposes of illustrating the invention, and are not meant to limit its scope. Upon review of the foregoing specification, those of skill in the art will immediately realize that there are numerous variations, modifications and adaptations to the concepts disclosed herein that are applicable to a variety of container manufacturing equipment, as well as to a variety of container bottom profiles. Moreover, although the present invention is particularly directed to the manufacture of drawn and ironed aluminum cans, it will be understood that the present invention is not limited solely to use with these containers. Therefore, in order to fully apprehend the scope of the present invention, reference should be made to the appended claims.

What is claimed is:

1. Apparatus for deforming an open end of a container having an open end and a closed end, the closed end forming an annular base, the annular base having a bottom portion and an interior portion, comprising:

one or more deforming means adapted to be inserted into the container; and a pusher pad having means for centering the container with respect to the deforming means, the centering means including:

(i) means for supporting the bottom portion of the container annular base, the supporting means including a flat surface against which the container bottom portion can rest;

(ii) means for engaging the interior portion of the container base, the engaging means including a pilot projecting outwardly from and being surrounded by the flat surface, the pilot having inclined sides adapted to mate with the interior portion of the annular base;

(iii) means for urging the container base into contact with the flat surface and the pilot, the urging means including means for creating a vacuum between the container base and the pusher pad.

2. The apparatus of claim 1, wherein the pusher pad comprises a substantially cylindrical structure.

3. The apparatus of claim 1, wherein the pusher pad has an outside diameter, the pilot having a diameter less than the outside diameter of the pusher pad.

4. The apparatus of claim 1, wherein the pusher pad is a substantially cylindrical structure comprising a section turned to a plurality of diameters, wherein the pusher pad cooperates with the deforming means to be withdrawn from and inserted into the bottom dome.

5. The apparatus of claim 1, wherein a height of the pilot above the flat surface is at least about 0.3 inches.

6. The apparatus of claim 1, wherein the means for creating a vacuum includes a passage extending through the pusher pad.

7. The apparatus of claim 1, wherein the deforming means comprises forming rollers.

8. Apparatus for necking an open end of a container having a bottom dome and an annular base comprising:

one or more neck dies inserted into the container; and a pusher pad having a flat surface upon which the annular base of the container can rest extending from a pilot to a periphery of the pad, the pilot having a cross-sectional width at a top that is smaller than a cross-sectional width at a bottom and an inclined side upon which an interior of the annular base of the container can rest and a height that is great enough to center the container on the pad and small enough to prevent stripping during necking operations and a channel disposed within the pad through which a vacuum can be created when the container rests on the pad to hold the container on the pad when the neck dies are inserted into the container.

9. The apparatus of claim 8, wherein the pusher pad comprises a substantially cylindrical structure.

10. The apparatus of claim 8, wherein the pusher pad has an outside diameter, the pilot having a diameter less than the outside diameter of the pusher pad.

11. The apparatus of claim 8, wherein the pusher pad is a substantially cylindrical structure comprising a section turned to a plurality of diameters, wherein the pusher pad cooperates with the necking dies to be withdrawn from and inserted into the bottom dome.

12. The apparatus of claim 8, wherein the pusher pad is spring-loaded to create resistive force between the pad and the container.

13. The apparatus of claim 12, wherein the pusher pad further comprises a substantially cylindrical body and one or more spring loaded buttons.

14. The apparatus of claim 8, wherein the height of the pilot above the flat surface is at least about 0.3 inches.

15. A method of flanging a container comprising:

providing a pusher pad having a flat surface upon which an annular base of the container can rest extending from a pilot to a periphery of the pad, the pilot having a cross-sectional width at a top that is smaller than a cross sectional width at a bottom and an inclined side upon which an interior of the annular base can rest and a height that is great enough to center the container on the surface and small enough to prevent stripping during operation of flanging rollers;

inserting the pilot of the pusher pad into a dome of the container;

resting the annular base of the container on the surface;

pressing the base of the container against the surface by drawing a vacuum through a channel disposed in the pad;

inserting forming rollers into an open end of the container; and flanging the container with the rollers.

16. The method of claim 15, further comprising the step of creating a force between the container and the surface to push the container off of the surface with a spring disposed in the pad after the step of flanging.

17. The apparatus of claim 15, wherein the height of the pilot above the flat surface is at least about 0.3 inches.

18. A method of necking a container comprising:

providing a pusher pad having a flat surface upon which an annular base of the container can rest extending from a pilot to a periphery of the pad, the pilot having a cross-sectional width at a top that is smaller than a cross sectional width at a bottom and an inclined side upon which an interior of the annular base can rest and a height that is great enough to center the container on the surface and small enough to prevent stripping during necking;

inserting the pilot of the pusher pad into a dome of the container;

resting the annular base of the container on the surface;

pressing the base of the container against the surface by drawing a vacuum through a channel disposed in the pad; and die necking an open end of the container.

19. The method of claim 18, further comprising the step of creating a force between the container and the surface to push the container off of the surface with a spring disposed in the pad after the step of necking.

20. The apparatus of claim 18, wherein the height of the pilot above the flat surface is at least about 0.3 inches.

* * * * *

UNITED STATES PATENT AND TRADEMARK OFFICE

CERTIFICATE OF CORRECTION

PATENT NO. : 5,813,267

DATED : September 29, 1998

INVENTOR(S) : Cook et al.

It is certified that error appears in the above-indentified patent and that said Letters Patent is hereby corrected as shown below:

Column 2, Line 62, delete "11-11" and insert --II-II-- therefor.
Column 3, Line 3, delete "piloted usher pad" and insert --piloted pusher pad-- therefor.
Column 3, Line 11, delete "crass-sectioned" and insert --cross-sectioned-- therefor.

Signed and Sealed this

Sixth Day of July, 1999

*Attest:*

*Attesting Officer*

Q. TODD DICKINSON

*Acting Commissioner of Patents and Trademarks*